US010562726B2

(12) United States Patent
Clabbers et al.

(10) Patent No.: US 10,562,726 B2
(45) Date of Patent: Feb. 18, 2020

(54) APPARATUS AND METHOD FOR HANDLING TAKE-UP ROLLS IN A PRINTING SYSTEM

(71) Applicant: Océ-Technologies B.V., Venlo (NL)

(72) Inventors: Tom J. H. Clabbers, Venlo (NL); Anne A. Wind, Venlo (NL)

(73) Assignee: OCÉ-TECHNOLOGIES B.V., Venlo (NL)

( * ) Notice: Subject to any disclaimer, the term of this patent is extended or adjusted under 35 U.S.C. 154(b) by 195 days.

(21) Appl. No.: 15/893,190

(22) Filed: Feb. 9, 2018

(65) Prior Publication Data

US 2018/0162670 A1 Jun. 14, 2018

Related U.S. Application Data

(63) Continuation of application No. PCT/EP2016/068936, filed on Aug. 9, 2016.

(30) Foreign Application Priority Data

Aug. 18, 2015 (EP) ..... 15181340

(51) Int. Cl.

| | |
|---|---|
| ***B65H 19/30*** | (2006.01) |
| ***B41J 15/04*** | (2006.01) |
| ***B65H 18/08*** | (2006.01) |

(52) U.S. Cl.

CPC ..... *B65H 19/30* (2013.01); *B41J 15/042* (2013.01); *B65H 18/08* (2013.01)

(58) Field of Classification Search

CPC .... B65H 19/30; B65H 18/08; B65H 19/2223; B65H 2301/41818; B65H 2301/41816; B41J 15/042

See application file for complete search history.

(56) References Cited

U.S. PATENT DOCUMENTS 1,711,556 A * 5/1929 Bleher ..... B29C 31/002 242/443
2,783,000 A * 2/1957 Gredigk ..... B29C 53/32 242/419.3
3,411,732 A * 11/1968 Ebneter ..... B65H 19/2223 242/527.2
3,421,709 A * 1/1969 Armelin ..... B65H 19/2223 242/532.3

(Continued)

FOREIGN PATENT DOCUMENTS

DE 2 020 379 11/1971
EP 0 135 662 A2 4/1985

*Primary Examiner* — William A. Rivera

(74) *Attorney, Agent, or Firm* — Birch, Stewart, Kolasch & Birch, LLP

(57) ABSTRACT

An apparatus for handling take-up rolls in a printing system includes a holder device for holding a take-up roll in a take-up position. The take-up roll is rotatable about a longitudinal axis thereof in the take-up position for taking-up printed sheet output from the printing system. The holder device is movable to release or discharge the take-up roll from the holder device when the take-up roll is full or when a print job is finished. A movement of the holder device to release or discharge a full take-up roll also operates to load a new take-up roll onto the holder device and into the take-up position. A corresponding method of handling take-up rolls in a printing system is disclosed.

20 Claims, 1 Drawing Sheet

(56) References Cited

U.S. PATENT DOCUMENTS

| | | | | | |
|---|---|---|---|---|---|
| 3,848,824 | A * | 11/1974 | Van Schijndel | B21C 47/245 | 242/527.4 |
| 4,723,724 | A * | 2/1988 | Bradley | B65H 19/2253 | 242/521 |
| 4,856,725 | A * | 8/1989 | Bradley | B65H 19/2253 | 242/533.2 |
| 4,886,219 | A * | 12/1989 | Achterwinter | B65H 19/28 | 242/532 |
| 6,000,657 | A * | 12/1999 | Butterworth | B65H 19/2269 | 242/521 |
| 2003/0080234 | A1* | 5/2003 | Baggot | B65H 18/10 | 242/532.3 |
| 2007/0057109 | A1* | 3/2007 | Reinhold | B65H 19/223 | 242/533.2 |

* cited by examiner

APPARATUS AND METHOD FOR HANDLING TAKE-UP ROLLS IN A PRINTING SYSTEM

CROSS REFERENCE TO RELATED APPLICATIONS

This application is a Continuation of PCT International Application No. PCT/EP2016/068936, filed on Aug. 9, 2016, which claims priority under 35 U.S.C. 119(a) to patent application Ser. No. 15/181,340.9, filed in Europe on Aug. 18, 2015, all of which are hereby expressly incorporated by reference into the present application.

FIELD OF THE INVENTION

The present invention relates to an apparatus and method for handling take-up rolls for taking-up printed sheet in a printing system, especially a roll-to-roll printing system. The present invention also relates to a printing system that includes such an apparatus for handling take-up rolls to improve and/or optimize productivity and work-flow of the system.

BACKGROUND OF THE INVENTION

In printing systems, and especially in roll-to-roll printing systems, in which printed sheet output from the system is gathered by winding the sheet onto a take-up roll, there is always the issue of managing the work-flow from the printing system when the take-up roll is full, i.e. when it reaches its maximum sheet-carrying capacity. At that time, it becomes necessary to replace the full take-up roll at the output end of the printing system, which typically requires a manual intervention by a system operator. If the printing continues, the printed sheet may be collected in a buffer until the new take-up roll is installed and ready for taking-up (e.g. winding up) the printed sheet. The time required for a manual intervention by an operator in this regard is typically several minutes. In this time, the printed sheet in the buffer can become creased or damaged and, if too much time is required by the operator, the printing system must be temporarily interrupted, which has a significant negative impact upon system productivity, as well as on the print quality of the printed sheet after re-starting the printing.

In EP0135662 A2 a continuous paper web, unwound from a feeding roll, is severed into sheets of the desired length. From the severing station, the web is advanced to a winding station, to which cardboard cores supported at their ends by two idle mandrels are also supplied. The winding station is defined by two endless belts diverging from each other in the direction of the outlet from this station and moved at different speeds.

At the inlet of the winding station, the cardboard cores are rotated by said belts, whereby the length of paper web advanced to said station by the lower belt is wound onto one of said cores. The so-formed roll is transferred to a discharge station, where it is released by disengaging the mandrels from the ends thereof. The two free mandrels are then transferred to a loading station where they pick up a new cardboard core. Drawbacks of the device in EP0135662 A2 are that it is relatively complex, large, and costly.

SUMMARY OF THE INVENTION

In view of the above, an object of the present invention is to provide a new and improved apparatus and method for handling take-up rolls in a printing system, and especially in a roll-to-roll printing system, and a printing system which includes such an apparatus.

In accordance with the present invention, an apparatus for handling take-up rolls as recited in claim 1 and a method of handling take-up rolls as recited in claim 9 are provided. Advantageous or preferred features of the invention are recited in the dependent claims.

According to one aspect, therefore, the present invention provides an apparatus for handling take-up rolls, and especially for loading and unloading take-up rolls, in a printing system, such as a roll-to-roll printing system. The apparatus comprises a holder device for holding a take-up roll in a take-up position, wherein the take-up roll is rotatable about a longitudinal axis thereof in the take-up position for taking-up printed sheet output from the printing system. The holder device comprises a circumferential surface whereupon a holding portion is provided for supporting an outer surface of the take-up roll. The holder device is movable to release or discharge the take-up roll from the holder device when the take-up roll is full or when a print job is finished, wherein a movement of the holder device to release or discharge a full take-up roll operates to load or to receive a new take-up roll onto the holder device and into the take-up position.

In this way, the invention provides an apparatus which is configured for loading and unloading take-up rolls to and from the take-up position automatically. In other words, the need for a manual intervention from an operator may be reduced to a minimum. This not only simplifies the procedure for changing over the take-up roll, but also significantly reduces the time required for performing the change-over, and this necessarily makes a substantial contribution to improving the productivity and work-flow of the printing system. Furthermore, the fact that the new take-up roll which is loaded onto the holder device is loaded directly into the take-up position to replace the full take-up roll that has just been released or discharged provides for very high efficiency in handling of the take-up rolls by the apparatus. Additionally, the invention provides an apparatus with a very compact construction, since the loading and unloading of take-up rolls may be performed by the motion of a single holder device. Due to its relatively simple construction, such an apparatus may be easily and cheaply implemented. Furthermore, the construction of the apparatus according to the invention is relatively simply, since the number of moving parts may be limited to that of the holder device.

In contrast to EP0135662 A2, the holder device according to the present invention requires only a single holder member for loading a roll onto the holder device, transporting the loaded roll from the take-up position to a release position, and unloading the roll from the holder device. The holder device according to the present invention combines said three functions in the holder member, whereas EP0135662 A2 requires various components to perform said functions. This advantage is achieved by allowing the take-up roll or rolls to be supported on the outer circumferential surface of the holder device, specifically of the holder member. Aside from its compact construction, the holder device according the present invention may be produced cheaply, for example in the form of an integrally formed holder member. The holder member may then, for example, be machine engineered or molded for easy and large scale production in steel or plastic form. Preferably, the holder member is formed of a rigid material for improved durability and accurate control.

In an embodiment, the holder device comprises a holder member for supporting the take-up roll. The holder member comprises the circumferential surface. The circumferential surface forms the outer surface or contour of the holder member, and runs endlessly around the holder member. Preferably, the circumferential surface is divided into a plurality of holding portions. The holding portions are then circumferentially positioned besides or next to one another on the circumferential surface. A holding portion is arranged for supporting a take-up roll and holding the take-up roll in the holding portion under the influence of a holding force. This holding force is, in a preferred embodiment, provided by gravity. Moving the holder device, moves a first holding portion from a take-up position to a release position for releasing a take-up roll supported on the first holding portion. Moving the holder device further moves a second (or in a basic embodiment the first) holding portion from a loading position (for loading a new take-up roll onto the second holding portion) to the take-up position. A new and empty take-up roll is thereby positioned for receiving and winding up printed web material. Additionally, moving the holder device may move a third (or in a basic embodiment the first and/or second) empty holding portion from the release position to the loading position for loading a new and empty take-up roll onto the third holding portion. This process may be repeated cyclically for efficient and operator-friendly operation. It will be appreciated that a holding portion move between two of the above mentioned position either continuously (in the case of one, two, or three holding portions), or in steps (in the case of more than three holding portions).

In another embodiment, the circumferential surface of the holder device is provided with a plurality of circumferentially spaced apart protrusions, which define a plurality of holding portions on the circumferential surface. The protrusions extend out of the plane of the circumferential surface and divide or separate the holding portions from one another. A protrusion extends laterally, in a width direction of the holder member, over the holder member between two adjacent holding portions. Thereby, a cup-shaped recess is formed for holding a take-up roll on the holder device under the influence of gravity. Preferably, the holder member and the protrusions are integrally formed for cheap and easy manufacturing.

In a preferred embodiment, the holder device is rotatable to release or discharge the take-up roll from the holder device when the take-up roll is full or when a print job is finished. Thus, a rotation of the holder device to release or discharge a full take-up roll also operates to load a new take-up roll onto the holder device and into the take-up position. In other words, the holder device comprises a rotatable holder member which supports or holds the take-up roll in the take-up position, and rotation of the holder member effects both unloading of the full take-up roll as well as loading of the new take-up roll.

In a preferred embodiment, the holder device, and especially the rotatable holder member, comprises a plurality of holding portions, each of which is configured to receive and support a take-up roll. Each of the holding portions is respectively movable, e.g. rotatable, from a loading position (i.e. at which the take-up roll is loaded or received onto the holder device) to the take-up position, and from the take-up position to a release position (i.e. at which the take-up roll is released or discharged from the holder device).

In a particularly preferred embodiment, therefore, the holder device includes a first holding portion and a second holding portion. The first and second holding portions are configured to move simultaneously with one another and, when the first holding portion moves from the take-up position to the release position to release or eject a full take-up roll from the holder device, the second holding portion moves from the loading position to the take-up position to load or receive a new take-up roll onto the holder device. In this way, a single (e.g. rotary) movement of the holder device, and especially the rotatable holder member, performs both the unloading of one take-up roll and the loading of the new take-up roll. This provides a very direct and efficient manner of handling the take-up rolls, which also assists the optimization of the printing system.

In a further particularly preferred embodiment, the holder device includes a third holding portion configured to move simultaneously with the first and second holding portions. The third holding portion is positioned and arranged such that, when the first holding portion moves from the take-up position to the release position in order to release or discharge a full take-up roll from the holder device, the third holding portion moves from the release position to the loading position. In this way, the third holding portion may provide an intermediate holding portion that moves to replace the second holding portion functionally in the loading position, as or when the second holding portion moves to the take-up position.

Each holding portion of the holder device (e.g. of the holder member) may include a pair of fingers or prongs between which a take-up roll is received and supported, e.g. in the take-up position. Furthermore, each holding portion preferably includes a support surface which either substantially conforms with, or follows a profile of, an outer surface of the take-up roll.

In a preferred embodiment, the apparatus further comprises a roll supply, which may be in the form of a hopper, for storing a plurality of take-up rolls for taking-up printed sheet or web. In this regard, the take-up rolls are typically in the form of roll "cores" onto which the printed sheet may be wound. The take-up rolls or roll "cores" are typically tubular or cylindrical rolls and may be comprised of cardboard or plastic or any other suitable material. The roll supply is configured to deliver each of the rolls stored in the supply individually to the holder device at the loading position, preferably via a gravity-feed configuration.

In a preferred embodiment, the apparatus further comprises a collector unit for collecting the take-up rolls released or discharged from the holder device. In this regard, the collector unit is desirably configured to store the take-up rolls in a sequence corresponding to an order or chronology of their release or discharge from the holder device. In this way, the collector unit enables an operator to easily correlate the discharged take-up rolls held within the collector unit to one or more particular printing jobs.

In a preferred embodiment, the apparatus further comprises a control unit which controls movement of the holder device. In particular, the control unit may include a sensor for sensing or detecting when a take-up roll has reached capacity or is full and needs to be changed. Further, the control unit may also include a sensor for sensing or detecting when a print job is finished and be configured to receive and/or send control signals to control movement of the holder device based on this information. By controlling the movement of the holder device to unload—i.e. to release or discharge—a full take-up roll, the apparatus automatically operates to load a new take-up roll from the roll supply.

In another embodiment, the holder device is rotatable about an axis of rotation. The rotation of the holder device for releasing or discharging a full take-up roll as well as the rotation loading a new take-up roll onto the holder device into the take-up position comprises a rotation over an angle of approximately 120° around the axis of rotation. The holder device is arranged to rotate over substantially one third of a turn to load and unload rolls. Preferably, the holder device comprises three holding portions, arranged angularly (and preferably regularly) around the rotation axis. In a further embodiment, the three holding portions may be positioned and/or configured with three-fold rotation symmetry with respect to the axis of rotation for improved operation.

In a further embodiment, the holder device being rotatable about an axis of rotation may imply or comprise a rotation of a part of or position on the holder device around an axis of rotation. Specifically, a holding portion on the holder device is rotatable about the axis of rotation. Being rotatable may include a rotation over any angle, for example 180° or less. Basically, the rotation of the holder device defines an endless holding portion transport path along which each holding portion moves in a cyclic motion. In a compact embodiment, the holding portion transport path is circular. In another embodiment, the endless holding portion transport path may comprise an irregular shape, which shape is defined by the shape or form of the holder device. The cyclic motion allows for continuous and uninterrupted operation.

In another embodiment, a rotation of the holder device to release or discharge a full take-up roll comprises a rotation of a first holding portion on the holder device around a first axis of rotation. Said rotation may be over any predefined angle, for example angles smaller than 180°, specifically around 120°. The rotation of the first holding portion on the holder device around the first axis of rotation also operates to load a new take-up roll onto a second holding portion on the holder device into the take-up position. A first rotation of the first holding portion drives a second rotation of the second holding portion to load a new take-up roll onto the second holding portion. In a compact embodiment, the second rotation of the second holding portion is around the first axis of rotation. In another embodiment, the second rotation of the second holding portion is around a second axis of rotation, spaced apart from the first axis of rotation. The first rotation operating the second rotation may imply a coupled or synchronous movement of the first and second holding portions. The holder device connects the first holding portion to the second holding portion, such that these move in a coupled motion along the holding portion transport path defined by the holder device. In an embodiment with the first and second rotation axes spaced apart from one another, the holder device may be an endless transport belt with multiple holding portions. The transport belt is supported on two or more support rollers. The support roller defines the first and second axis of rotation. As the holding portion on the belt rotates over a predefined first angle around a first support roller, a roll is unloaded from the first holding portion, while a, preferably simultaneous, rotation around a second support roller over a predefined second angle loads a new take-up roll onto the second holding portion. The holder device couples the holding portions together, such that the motion of one of the holding portions incurs motion of the other holding portion(s). A wide variety of configurations is thus available to the operator, who may configure the apparatus according to the present invention in accordance with his or her own specifications or those of the device.

According to another aspect, the present invention provides an apparatus for handling take-up rolls, and especially for loading and unloading take-up rolls, in a printing system, such as a roll-to-roll printing system. The apparatus comprises a holder device for holding a take-up roll in a take-up position, wherein the take-up roll is rotatable about a longitudinal axis thereof in the take-up position for taking-up printed sheet output from the printing system. The holder device is movable to release or discharge the take-up roll from the holder device when the take-up roll is full or when a print job is finished, wherein a movement of the holder device to release or discharge of a full take-up roll operates to load or to receive a new take-up roll onto the holder device and into the take-up position. The holder device is formed or configured such that a single movement of the holder device operates the discharging a full take-up roll from the holder device as well as the loading of a new take-up roll onto the holder device. In a preferred embodiment, the holder device comprises a first and second holding portion, wherein the holder device is configured to move, such that its motion pivots or rotates the first holding portion for discharging a full take-up roll from the first holding portion, while its motion pivots or rotates the second holding portion to receive a new take-up roll onto the second holding portion. Preferably, the holder device is arranged for moving along an endless path. The first and second holding portions on the holder device are then moved in cyclic motion along an endless holding portion transport path, which allows for continuous and uninterrupted operation.

According to another aspect, the invention provides a method of handling take-up rolls for taking-up printed sheet in a printing system, especially a roll-to-roll printing system, comprising the steps of:

holding a take-up roll in a holder device in a take-up position, whereby the take-up roll is rotatable about a longitudinal axis thereof in the take-up position for taking-up printed sheet output from the printing system, wherein the holder device comprises a circumferential surface whereupon a holding portion is provided for supporting an outer surface of the take-up roll, and moving the holder device to release or to discharge the take-up roll from the holder device when the take-up roll is full or when a print job is finished, whereby moving the holder device to release or discharge a full take-up roll operates to load a new take-up roll onto the holder device and into the take-up position.

As discussed above, the invention is configured for loading and unloading take-up rolls for taking up the printed sheet to and from the take-up position in a printing system automatically. In this way, a manual intervention from an operator can be reduced to simplify the procedure for changing over a take-up roll and productivity and work-flow of the printing system can be significantly improved. Furthermore, by loading the new take-up roll onto the holder device and directly into the take-up position to replace the full take-up roll just released or discharged provides for highly efficient handling of the take-up rolls.

In a preferred embodiment, the step of moving the holder device includes rotating the holder device to release or to discharge the take-up roll from the holder device when the take-up roll is full or when a print job is finished. In this regard, rotating the holder device also operates to load a new take-up roll onto the holder device into the take-up position.

In a preferred embodiment of the invention, the holder device includes a plurality of holding portions, each of which is configured to receive and support a take-up roll, wherein the step of moving the holder device comprises:

moving, especially rotating, each or a respective holding portion (i) from a loading position, at which the take-up roll is loaded or received onto the holder device, to the take-up position, and (ii) from the take-up position to a release position, at which the take-up roll is released or discharged from the holder device.

In a particularly preferred embodiment, the holder device includes a first holding portion and a second holding portion, wherein the step of moving the holder device comprises:

moving, e.g. rotating, the first and second holding portions simultaneously with one another, whereby, when the first holding portion moves from the take-up position to the release position to release or discharge a full take-up roll from the holder device, the second holding portion moves from the loading position to the take-up position to load or receive a new take-up roll onto the holder device.

In a preferred embodiment, the method further comprises the steps of:

storing a plurality of take-up rolls for taking-up printed sheet in a roll supply, especially a hopper, and delivering each of the rolls stored in the supply individually to the holder device at the loading position, preferably via a gravity-feed configuration.

In a preferred embodiment, the method further comprises the step of:

collecting the take-up rolls released or ejected from the holder device in a collector unit, whereby the take-up rolls are collected and stored in the collector unit in a sequence which corresponds to their release from the holder device.

According to another aspect, the invention provides a method of handling take-up rolls for taking-up printed sheet in a printing system, especially a roll-to-roll printing system, comprising the steps of:

holding a take-up roll in a holder device in a take-up position, whereby the take-up roll is rotatable about a longitudinal axis thereof in the take-up position for taking-up printed sheet output from the printing system, and moving the holder device to release or to discharge the take-up roll from the holder device when the take-up roll is full or when a print job is finished, whereby moving the holder device to release or discharge a full take-up roll operates to load a new take-up roll onto the holder device and into the take-up position.

According to a further aspect, the present invention provides a printing system comprising an apparatus for handling take-up rolls for taking-up printed sheet according to any one of the embodiments described above, and/or for performing a method of handling take-up rolls for taking-up printed sheet according to any one of the embodiments described above.

BRIEF DESCRIPTION OF THE DRAWINGS

For a more complete understanding of the invention and the advantages thereof, exemplary embodiments of the invention are explained in more detail in the following description with reference to the accompanying drawing figures, in which like reference characters designate like parts and in which.

The accompanying drawings are included to provide a further understanding of the present invention and are incorporated in and constitute a part of this specification. The drawings illustrate particular embodiments of the invention and together with the description serve to explain the principles of the invention. Other embodiments of the invention and many of the attendant advantages of the invention will be readily appreciated as they become better understood with reference to the following detailed description.

It will be appreciated that common and/or well understood elements that may be useful or necessary in a commercially feasible embodiment are not necessarily depicted in order to facilitate a more abstracted view of the embodiments. The elements of the drawings are not necessarily illustrated to scale relative to each other. It will further be appreciated that certain actions and/or steps in an embodiment of a method may be described or depicted in a particular order of occurrences while those skilled in the art will understand that such specificity with respect to sequence is not actually required. It will also be understood that the terms and expressions used in the present specification have the ordinary meaning as is accorded to such terms and expressions with respect to their corresponding respective areas of inquiry and study, except where specific meanings have otherwise been set forth herein.

DETAILED DESCRIPTION OF EMBODIMENTS

Figure 1:
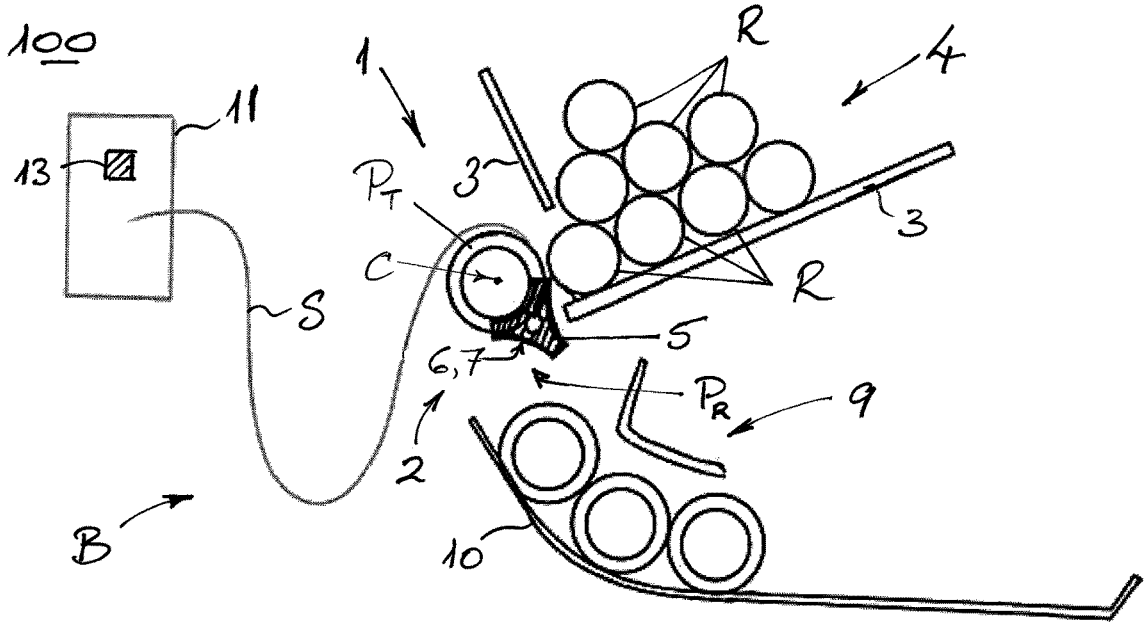
FIG. 1 is a schematic side view of an apparatus for handling take-up rolls in a printing system according to an embodiment of the invention.

With reference firstly to FIG. 1 of the drawings, an apparatus 1 for handling take-up rolls R for taking-up printed sheet S in a roll-to-roll printing system 100 is illustrated schematically. The apparatus 1 includes a holder device 2 mounted on a frame 3 of the apparatus 1 for holding a take-up roll R in a take-up position $P_T$, such that the take-up roll R is able to rotate about its central longitudinal axis C in the take-up position $P_T$ for taking-up printed sheet S output from the printing system 100. In this regard, the take-up roll R comprises a tubular or cylindrical roll core typically made of cardboard or plastic which is driven in the take-up position $P_T$ to rotate about its central axis C in order to wind up the printed sheet S as it emerges from the printing heads or from a drying and fixing portion of the printing system 100. The printing system 100 will usually include a buffer region B in which a section of the printed sheet S may accumulate prior to being wound onto the take-up roll R in order to accommodate slight differences in the speed between the rotating take-up roll R and the sheet S as it emerges from the printing heads and/or from the drying and fixing portion of the printing system 100. Between the buffer region B and the apparatus 1 a sheet clamping unit may be present for holding the sheet S or web medium S during a roll changing operation.

As can be seen in FIG. 1, the apparatus 1 comprises a roll supply 4 for storing a plurality of take-up rolls R, each of which is provided as a tubular or cylindrical roll core typically made of cardboard or plastic. The roll supply 4 is in the form of a hopper mounted on the frame 3 of the apparatus 1 and is configured to guide or feed each of the rolls R individually, preferably under gravity, to a loading position $P_L$ at or adjacent to the holder device 2.

Figure 2:
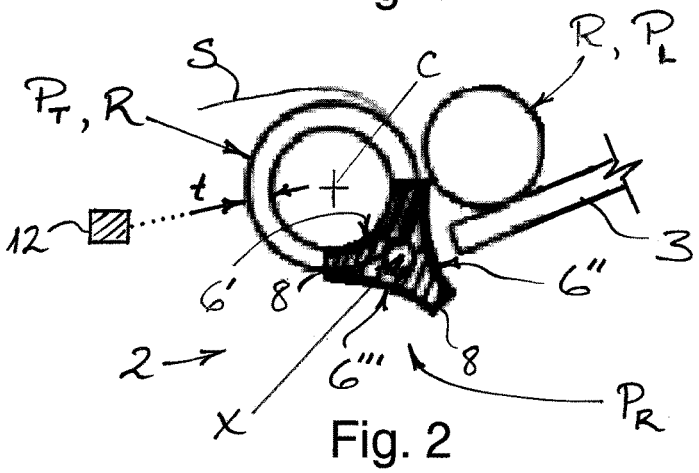
FIG. 2 is a detailed side view of part of the apparatus shown of FIG. 1.

With reference now also to FIG. 2 of the drawings, the holder device 2 comprises a holder member 5 which is rotatable about an axis X of rotation (i.e. parallel to the axis C of the take-up roll R in the take-up position $P_T$) and includes three separate holding portions 6, namely a first holding portion 6', a second holding portion 6", and a third holding portion 6'". The holding portions 6', 6", 6'" are positioned on the circumferential surface of the holder member 5. These holding portions 6 are spaced around the holder member 5 and each is configured to receive and support a take-up roll R thereon. In this regard, each of the holding portions 6 has a respective support surface 7 that generally follows a contour of an outer surface of the take-up roll R supported thereon. Furthermore, each holding portion 6 extends between or includes prong- or finger-like protrusions 8. The first, second and third holding portions 6', 6", 6'" are all formed integrally as part of the holder member 5 and are thus configured to move simultaneously with one another.

The holder device 2 may be arranged to support a take-up roll R along the full length of the take-up roll R. Preferably, the holder device 2 is arranged to support the take-up roll R at at least two spaced apart positions. These positions may be spaced apart more than the width of the sheet S, such that the holder device 2 supports the take-up roll R at either side of the sheet S during take-up. The holder device 2 may support the take-up roll R or roll core R directly or may support the take-up roll R by supporting a roll core holder inserted into the take-up roll R. Such a roll core holder may comprise driving means for driving the rotation of the take-up roll 2. Alternatively, the take-up roll R may be driven directly.

The holder device 2 is configured such that it is rotatable to release or to discharge the take-up roll R from its position on the holder device 2 when the take-up roll R is full or when a print job is finished. In this regard, a rotation of the holder device 2 to release or discharge the full take-up roll R also operates to load a new take-up roll R onto the holder device 2 and into the take-up position $P_T$. More particularly, when the holder member 5 rotates about the axis X, the first holding portion 6' then moves from the take-up position $P_T$ to the release position $P_R$ to release or eject the full take-up roll R from the holder device 2 to a collector unit 9. The collector unit 9 is designed to collect the full take-up rolls R released or discharged from the holder device 2. In this regard, the collector unit 9 is desirably configured to receive the full take-up rolls R gently via a gradually sloping guide path 10, which stores the take-up rolls R in a sequence corresponding to the order of their release from the holder device 2.

When the first holding portion 6' moves from the take-up position $P_T$ to the release position $P_R$ during rotation of the holder member 5 about the axis X, the second holding portion 6" moves from the loading position $P_L$ to the take-up position $P_T$ and thereby loads or receives a new take-up roll R from the supply 4 onto the holder device 2. As will be apparent from the drawings, when the first holding portion 6' of the holder member 5 rotates from the take-up position $P_T$ to the release position $P_R$ to release or discharge the full take-up roll R from the holder device 2, the third holding portion 6'" of the holder member 5 rotates from the release position $P_R$ to the loading position $P_L$ to be position ready for the next take-up roll loading operation.

The apparatus 1 shown in the drawings further includes a control unit 11 to control the movement of the holder device 2. In particular, the control unit 11 includes a sensor 12 for sensing or detecting when a take-up roll has reached capacity or is full and needs to be changed. In this regard, the sensor may detect the amount of printed sheet S already wound onto the take-up roll in the take-up position $P_T$; for example, via a thickness t of the wound amount of the sheet S. Alternatively, or in addition, the control unit 11 may include a sensor 13 for detecting or registering when a print job is finished. In any case, the control unit 11 is configured to send control signals to control movement of the holder device 2 based on the data or information provided by sensors 12, 13. By controlling the movement of the holder device 2 in this way to unload—i.e. to release or discharge—a full take-up roll R, the apparatus 1 then automatically operates to load or to receive a new take-up roll R form the roll supply 4 onto the holder device 2 and directly into the take-up position $P_T$.

Figure 3:
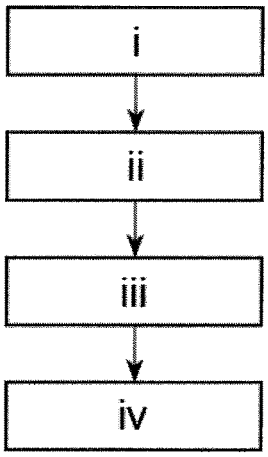
FIG. 3 is a flow diagram which schematically illustrates a method according to a preferred embodiment of the invention.

Finally, referring to FIG. 3 of the drawings, a flow diagram is shown that illustrates schematically the steps in a method of handling take-up rolls R in a printing system 100 according to the preferred embodiment of the invention described above with respect to drawing FIGS. 1 and 2. In this regard, the first box i of FIG. 3 represents the step of holding a take-up roll R in a holder device 2 in a take-up position $P_T$. The take-up roll R is rotatable about its central longitudinal axis X in the take-up position $P_T$ for taking-up the printed sheet S output from the printing system 100. The second box ii represents the step of sensing or detecting when the take-up roll R is full of printed sheet and/or when the print job is finished; for example via sensors 12, 13 connected with control unit 11. The third box iii then represents the step of moving the holder device 2 to release or to discharge the take-up roll R from the holder device (2) when the take-up roll R is full or when a print job is finished. This may, for example, involve rotating the holder device 2 via the control unit 11 such that a first holding portion 6' of the holding device in or on which the take-up roll R is held and supported moves to a release position $P_R$ in which the take-up roll R is released or discharged to the collector unit 9. The final box iv in drawing FIG. 3 then represents the step of simultaneously moving the holder device 2 to load a new take-up roll R onto the holder device 2 and into the take-up position $P_T$ as the holder device 2 releases or discharges the full take-up roll R. In this regard, the movement (e.g. rotation) of the holder device 2 preferably occurs as a single movement.

Although specific embodiments of the invention are illustrated and described herein, it will be appreciated by those of ordinary skill in the art that a variety of alternate and/or equivalent implementations exist. It should be appreciated that the exemplary embodiment or exemplary embodiments are examples only and are not intended to limit the scope, applicability, or configuration in any way. Rather, the foregoing summary and detailed description will provide those skilled in the art with a convenient road map for implementing at least one exemplary embodiment, it being understood that various changes may be made in the function and arrangement of elements described in an exemplary embodiment without departing from the scope as set forth in the appended claims and their legal equivalents. Generally, this application is intended to cover any adaptations or variations of the specific embodiments discussed herein.

It will also be appreciated that in this document the terms "comprise", "comprising", "include", "including", "contain", "containing", "have", "having", and any variations thereof, are intended to be understood in an inclusive (i.e. non-exclusive) sense, such that the process, method, device, apparatus or system described herein is not limited to those features or parts or elements or steps recited but may include other elements, features, parts or steps not expressly listed or inherent to such process, method, article, or apparatus. Furthermore, the terms "a" and "an" used herein are intended to be understood as meaning one or more unless explicitly stated otherwise. Moreover, the terms "first", "second", "third", etc. are used merely as labels, and are not intended to impose numerical requirements on or to establish a certain ranking of importance of their objects.

LIST OF REFERENCE SIGNS

1 apparatus
2 holder device

3 frame
4 roll supply
5 holder member
6 holding portion
6' first holding portion
6" second holding portion
6'" third holding portion
7 support surface
8 finger or prong
9 collector unit
10 guide path of collector unit
11 control unit
12 sensor
13 sensor
100 printing system
R take-up roll or roll core
S printed sheet
C central or rotational axis of take-up roll
B buffer region
X rotational axis of holder device
$P_T$ take-up position
$P_R$ release position
$P_L$ load position
t thickness

The invention claimed is:

1. An apparatus for handling take-up rolls in a printing system for taking-up printed sheet, comprising:

a holder device for holding a take-up roll in a take-up position, wherein the take-up roll is rotatable about a longitudinal axis thereof in the take-up position for taking-up printed sheet output from the printing system, wherein the holder device comprises an outer circumferential surface whereupon a holding portion is provided for supporting an outer surface of the take-up roll, the holding portion being formed as a recess in the outer circumferential surface of the holder device, wherein the holder device is movable to release or to discharge the take-up roll from the holder device when the take-up roll is full or when a print job is finished, and wherein a movement of the holder device to release or discharge a full take-up roll also operates to load a new take-up roll onto the holder device and into the take-up position.

2. The apparatus according to claim 1, wherein the holder device is rotatable to release or discharge the take-up roll from the holder device when the take-up roll is full or when a print job is finished, and wherein a rotation of the holder device to release or discharge a full take-up roll also operates to load a new take-up roll onto the holder device into the take-up position.

3. The apparatus according to claim 1, wherein the holder device comprises a plurality of holding portions, each of which is configured to receive and support a take-up roll, each of the holding portions being respectively movable from a loading position at which the take-up roll is loaded or received onto the holder device to the take-up position, and from the take-up position to a release position at which the take-up roll is released or discharged from the holder device.

4. The apparatus according to claim 3, the holder device including a first holding portion and a second holding portion, wherein the first and second holding portions are configured to move simultaneously with one another, and wherein, when the first holding portion moves from the take-up position to the release position to release or discharge a full take-up roll from the holder device, the second holding portion moves from the loading position to the take-up position to load or receive a new take-up roll onto the holder device.

5. The apparatus according to claim 4, the holder device including a third holding portion, wherein the third holding portion is configured to move simultaneously with the first and second holding portions and wherein, when the first holding portion moves from the take-up position to the release position to release or discharge a full take-up roll from the holder device, the third holding portion moves from the release position to the loading position.

6. The apparatus according to claim 3, wherein each of the holding portions is respectively rotatable from the loading position at which the take-up roll is loaded or received onto the holder device to the take-up position, and from the take-up position to the release position at which the take-up roll is released or discharged from the holder device.

7. The apparatus according to claim 6, wherein a rotation of the holder device from the loading position to the take-up position and a rotation of the holder device from the take-up position to the release position are each comprises a rotation over an angle of approximately 120° around an axis of rotation.

8. The apparatus according to claim 1, further comprising a roll supply, especially in the form of a hopper, for storing a plurality of take-up rolls for taking-up printed sheet, wherein the roll supply is configured to deliver individually each of the rolls stored in the supply to the holder device at the loading position, preferably via a gravity-feed configuration.

9. The apparatus according to claim 1, further comprising a collector unit for collecting the take-up rolls released or discharged from the holder device, wherein the collector unit is configured to store the take-up rolls in a sequence which corresponds to their release from the holder device.

10. The apparatus according to claim 1, wherein each holding portion of the holder device comprises fingers or prongs between which a roll is received and supported, preferably on a support surface which substantially conforms with a surface of the roll.

11. A printing system which comprises the apparatus according to claim 1.

12. The apparatus according to claim 1, wherein the holding device comprises a plurality of holder portions, and the outer circumferential surface of the holder device is provided with a plurality of circumferentially spaced apart protrusions, which extend out of the outer circumferential surface and separate the plurality of holding portions from one another.

13. The apparatus according to claim 1, wherein said holder portion includes a support surface which substantially conforms with an outer surface of the take-up roll.

14. The apparatus according to claim 1, wherein said holder portion is formed by a portion of the outer circumferential surface being recessed toward an axis of rotation of the holder device to thereby form a concave surface, said concave surface being a support surface of the holder portion configured to support the take-up roll along a full length of the take-up roll.

15. A method of handling take-up rolls in a printing system, especially in a roll-to-roll printing system, comprising the steps of:

holding a take-up roll in a holder device in a take-up position, whereby the take-up roll is rotatable about a longitudinal axis thereof in the take-up position for taking-up printed sheet output from the printing system, wherein the holder device comprises an circumferential surface whereupon a holding portion is provided for supporting an outer surface of the take-up roll, the holding portion being formed as a recess in the outer circumferential surface of the holder device, moving the holder device to release or to discharge the take-up roll from the holder device when the take-up roll is full or when a print job is finished;

whereby moving the holder device to release or discharge a full take-up roll operates to load a new take-up roll onto the holder device and into the take-up position.

16. The method according to claim 15, wherein the step of moving the holder device comprises rotating the holder device to release or discharge the take-up roll from the holder device when the take-up roll is full or when a print job is finished, whereby rotating the holder device operates to load a new take-up roll onto the holder device into the take-up position.

17. The method according to claim 15, wherein the holder device comprises a plurality of holding portions, each of which is configured to receive and support a take-up roll, wherein the step of moving the holder device comprises:

moving, especially rotating, each or a respective holding portion from a loading position at which the take-up roll is loaded or received onto the holder device to the take-up position, and from the take-up position to a release position at which the take-up roll is released or discharged from the holder device.

18. The method according to claim 15, wherein the holder device includes a first holding portion and a second holding portion, and wherein the step of moving the holder device comprises:

moving the first and second holding portions simultaneously with one another, whereby, when the first holding portion moves from the take-up position to the release position to release or discharge a full take-up roll from the holder device, the second holding portion moves from the loading position to the take-up position to load or receive a new take-up roll onto the holder device.

19. The method according to claim 15, further comprising the steps of:

storing a plurality of take-up rolls for taking-up printed sheet in a roll supply, especially a hopper, and delivering each of the rolls stored in the supply individually to the holder device at the loading position, preferably via a gravity-feed configuration.

20. The method according to claim 15, further comprising the step of:

collecting the take-up rolls released or discharged from the holder device in a collector unit, whereby the take-up rolls are collected and stored in the collector unit in a sequence which corresponds to their release from the holder device.

* * * * *